US010781780B2

(12) United States Patent
Mikhaylov et al.

(10) Patent No.: US 10,781,780 B2
(45) Date of Patent: Sep. 22, 2020

(54) FUEL INJECTION SYSTEM FOR AN INTERNAL COMBUSTION ENGINE

(71) Applicant: CONTINENTAL AUTOMOTIVE GMBH, Hannover (DE)

(72) Inventors: Yury Mikhaylov, Landshut (DE); Yavuz Kurt, Roding (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 15/947,481

(22) Filed: Apr. 6, 2018

(65) Prior Publication Data

US 2018/0291855 A1 Oct. 11, 2018

(30) Foreign Application Priority Data

Apr. 7, 2017 (DE) ..... 10 2017 205 949

(51) Int. Cl.

| | |
|---|---|
| ***F02M 63/00*** | (2006.01) |
| ***F02M 63/02*** | (2006.01) |
| ***F02M 61/18*** | (2006.01) |
| ***F02M 59/46*** | (2006.01) |

(52) U.S. Cl.

CPC ..... *F02M 63/005* (2013.01); *F02M 59/462* (2013.01); *F02M 61/1886* (2013.01); *F02M 63/0225* (2013.01); *F02M 63/0245* (2013.01)

(58) Field of Classification Search

CPC .... F02M 59/46; F02M 59/462; F02M 59/485; F02M 61/1886; F02M 63/005; F02M 63/0225

See application file for complete search history.

(56) References Cited

U.S. PATENT DOCUMENTS 4,513,719 A * 4/1985 Edo ..... F02M 47/02 123/447
4,562,486 A 12/1985 Suzuki et al.
5,477,829 A * 12/1995 Hassinger ..... F02M 37/10 123/467
5,655,503 A * 8/1997 Kampichler ..... F02B 75/16 123/510
6,352,067 B1 * 3/2002 Genslak ..... F02M 37/0029 123/510

(Continued)

FOREIGN PATENT DOCUMENTS

DE 2217066 A1 * 11/1972 ..... F02M 59/462
DE 2651586 B1 4/1978

(Continued)

OTHER PUBLICATIONS

German Office Action dated Mar. 6, 2018 for corresponding German Patent Application No. 10 2017 205 949.4.

(Continued)

*Primary Examiner* — John M Zaleskas

(57) ABSTRACT

The disclosure relates to a fuel injection system having a valve arrangement for connecting a pressure chamber of a high-pressure fuel pump to a high-pressure accumulator. The valve arrangement has an outlet valve and a pressure-limiting valve. An outlet valve seat and a pressure-limiting valve seat are formed on a common valve seat element which is formed in one piece, and are arranged eccentrically with respect to one another.

7 Claims, 4 Drawing Sheets

(56) References Cited

U.S. PATENT DOCUMENTS

| | | | | |
|---|---|---|---|---|
| 6,637,410 | B2 * | 10/2003 | Onishi | F02M 55/04 123/467 |
| 2001/0029925 | A1 * | 10/2001 | Ferry | F02M 55/00 123/456 |
| 2003/0127140 | A1 * | 7/2003 | Warlick | F16K 15/04 137/533.11 |
| 2004/0140009 | A1 * | 7/2004 | Yu | B60K 15/03 137/565.22 |
| 2004/0149266 | A1 * | 8/2004 | York | F02M 37/0029 123/461 |
| 2006/0231078 | A1 * | 10/2006 | Barylski | F02M 37/0029 123/511 |
| 2008/0279707 | A1 | 11/2008 | Fuchs et al. | |
| 2011/0126804 | A1 * | 6/2011 | Lucas | F02M 59/366 123/456 |
| 2011/0232779 | A1 * | 9/2011 | Oh | F16K 17/20 137/485 |
| 2012/0118269 | A1 * | 5/2012 | Ferry | F02M 59/462 123/459 |
| 2013/0213504 | A1 * | 8/2013 | Yabuuchi | F02M 63/005 137/565.15 |
| 2014/0305410 | A1 * | 10/2014 | Lucas | F02M 59/367 123/456 |
| 2015/0040868 | A1 * | 2/2015 | Graham | F16K 17/164 123/456 |
| 2015/0078922 | A1 * | 3/2015 | Oikawa | F04B 1/0452 417/213 |
| 2016/0169174 | A1 * | 6/2016 | Teike | F02M 63/0054 137/539 |

FOREIGN PATENT DOCUMENTS

| | | | | |
|---|---|---|---|---|
| DE | 7925377 | U1 | 12/1979 | |
| DE | 3149032 | A1 * | 6/1983 | F02M 59/462 |
| DE | 4307651 | A1 * | 9/1994 | F02B 75/16 |
| DE | 102004013307 | A1 | 9/2005 | |
| DE | 102011002826 | A1 * | 7/2012 | F02M 59/46 |
| EP | 0391509 | A1 * | 10/1990 | F02M 55/04 |
| GB | 444346 | A | 3/1936 | |
| GB | 444346 | A * | 3/1936 | F02M 59/462 |
| GB | 2058948 | A * | 4/1981 | F02M 59/462 |
| GB | 2269209 | A * | 2/1994 | F02M 55/04 |
| JP | 57191867 | U * | 12/1982 | |
| JP | S58202666 | A | 11/1983 | |
| JP | 60105868 | U * | 7/1985 | |
| JP | 60128969 | A * | 7/1985 | F02M 59/462 |
| JP | S63123763 | A | 5/1988 | |
| JP | 63123763 | U * | 8/1988 | F02M 59/462 |
| JP | 06033848 | A * | 2/1994 | F02M 55/04 |
| JP | H08144892 | A | 6/1996 | |
| JP | 3849067 | B2 * | 11/2006 | F02M 55/005 |
| KR | 20080075888 | A | 8/2008 | |
| KR | 20110051826 | A | 5/2011 | |

OTHER PUBLICATIONS

Notice of Reasons for Refusal, dated Feb. 4, 2019, for counterpart JP patent application 2018073781.

Written Opinion dated Apr. 23, 2019, for counterpart JP patent application 2018073781.

Office Action dated May 8, 2019, for counterpart KR patent application 10-2018-0039896.

Japanese Decision to Grant a Patent dated Sep. 20, 2019 for the counterpart Japanese Patent Application No. 2018-073781.

Indian Office Action dated Jul. 28, 2020 for the counterpart Indian Patent Application No. 201814007046.

* cited by examiner

FUEL INJECTION SYSTEM FOR AN INTERNAL COMBUSTION ENGINE

CROSS-REFERENCE TO RELATED APPLICATIONS

This application claims the benefit of German Application DE 10 2017 205 949.4, filed Apr. 7, 2017. The disclosures of the above application is incorporated herein by reference.

TECHNICAL FIELD

The disclosure relates to a fuel injection system for an internal combustion engine.

BACKGROUND

In so-called common-rail fuel injection systems, the generation of pressure in a fuel that is to be burned in an internal combustion engine and the injection of the fuel into combustion chambers of the internal combustion engine are decoupled. Here, a high-pressure fuel pump compresses the fuel fed to it from a low-pressure region, for example from a tank. At the outlet side of the high-pressure fuel pump, a volume flow of the compressed fuel then flows to a high-pressure accumulator, the so-called rail, from where the compressed fuel is then injected into the combustion chambers of the internal combustion engine. Here, the high-pressure fuel pump generates in the fuel a pressure in a range from 150 bar to 400 bar for example in the case of gasoline as fuel, and a pressure in a range from 1500 bar to 3000 bar in the case of diesel as fuel. The respective fuel is present in the high-pressure accumulator at this generated high pressure and is fed from the high-pressure accumulator via injection valves to the combustion chambers of the internal combustion engine.

To ensure the correct functioning of the fuel injection system, and to be able to possibly satisfy special demands, a fuel injection system generally has at least two valves, specifically firstly an outlet valve and secondly a pressure-limiting valve. The outlet valve functions as a high-pressure valve, which controls the pressure increase in a pressure chamber of the high-pressure fuel pump. During an upward movement of a pump piston, if the high-pressure fuel pump is designed as a piston pump, the outlet valve opens, and the fuel can be delivered into the high-pressure accumulator. During the downward movement of the pump piston, the outlet valve closes, such that a return flow of the compressed fuel from the high-pressure accumulator back into the pressure chamber is prevented.

The pressure-limiting valve has the function of preventing an excessive pressure increase in the high-pressure accumulator. If the pressure in the high-pressure accumulator exceeds a particular value, then a certain volume flow of the fuel is discharged via the pressure-limiting valve either into the high-pressure region or into the low-pressure region.

Each of the abovementioned valves—outlet valve and pressure-limiting valve—have hitherto been installed separately in a housing of the high-pressure fuel pump, wherein it is normally the case that the valves as a whole, or parts thereof, are pressed into the housing. Normally, the outlet valve and the pressure-limiting valve are situated very close together, and form a 90° angle with a piston axis of the pump piston. This is advantageous because both valves must be sealed off to the outside counter to a high pressure, which is normally implemented by a high-pressure connector under which both valves are positioned before the high-pressure connector is installed, for example by welding. The 90° angle is expedient in order to be able to accommodate both valves under the high-pressure connector.

Nevertheless, the individual installation of the two valves results in a very large space requirement. Furthermore, the high-pressure connector that is required as a sealing element to the outside is normally expensive.

In the case of a different pump design of the high-pressure fuel pump, both valves are installed separately and, in the high-pressure fuel pump, each require a dedicated installation space in the housing. Here, the outlet valve is again covered by the high-pressure connector, and a bore for the pressure-limiting valve is closed off by an additionally required and therefore expensive sealing element, for example an expander.

Due to the ever-increasing cost pressure, it is however desired to realize both a material saving in the housing and thus a reduction in structural space and also a reduction in price of the individual parts and assemblies.

SUMMARY

The disclosure proposes an improved fuel injection system having an outlet valve and having a pressure-limiting valve.

One aspect of the disclosure provides a fuel injection system for an internal combustion engine. The fuel injection system has a high-pressure fuel pump with a pressure chamber in which a pump piston moves during operation for highly pressurizing a fuel. The fuel injection system furthermore includes a high-pressure accumulator for storing the fuel that has been highly pressurized in the high-pressure fuel pump, and a valve arrangement for connecting the pressure chamber to the high-pressure accumulator. The valve arrangement has an outlet valve, with an outlet valve closing element which is preloaded onto an outlet valve seat counter to a pressure force acting from the pressure chamber, and a pressure-limiting valve, with a pressure-limiting valve closing element which is preloaded against a pressure limiting valve seat counter to a pressure force acting from the high-pressure accumulator. The outlet valve seat and the pressure-limiting valve seat are formed on a common valve seat element which is formed in one piece. Here, the outlet valve seat and the pressure-limiting valve seat are arranged eccentrically with respect to one another.

The valve seats of both valves, of the outlet valve and of the pressure-limiting valve, are combined in a single component, specifically such that the two valve seats are arranged eccentrically with respect to one another in order to thereby permit optimum hydraulic behavior of the high-pressure fuel pump in the event of a fault, for example, with regard to the reaction time. Due to the eccentric arrangement of the valve seats, the single component, such as the valve seat element, may be kept very short along a valve seat element longitudinal axis, which shortens the needed structural space in the high-pressure fuel pump or in the fuel injection system. Due to the combination of the valve seats, the number of individual parts is reduced, which leads to a cost saving.

The valve seat element is may be formed as a circular disk. The outlet valve closing element may, for example, be formed as a ball or as a plate, though the pressure-limiting valve closing element may also be formed as a ball or as a plate.

The respective valve seat may be formed at a passage bore through the valve seat element, where the passage bore is of cylindrical form on an inflow side of the respective valve, whereas the passage bore forms, for example, a conical valve seat on an outflow side of the respective valve.

In some implementations, the outlet valve seat has an outlet valve seat circumference and the pressure-limiting valve seat has a pressure-limiting valve seat circumference. A spacing of the outlet valve seat circumference to the pressure-limiting valve seat circumference is smaller than a diameter of the outlet valve closing element and/or of the pressure-limiting valve closing element.

As such, the distance between the sealing regions of the two valve seats is kept as short as possible, where the distance is smaller than the diameter of the largest closing element of the two valves in order to thereby permit optimum hydraulic behavior of the high-pressure fuel pump. This is because, if the sealing regions of the two valves are arranged very close together, optimum hydraulic behavior of the high-pressure fuel pump is realized in a fault situation, that is to say if the high-pressure fuel pump is in a full delivery situation and the excess fuel must be discharged via the pressure-limiting valve. The result is a short reaction time.

In some examples, a thickness of the valve seat element along a valve seat element longitudinal axis is smaller than an outlet valve seat diameter and/or a pressure-limiting valve seat diameter. In this way, the valve seat element is relatively short along its valve seat element longitudinal axis, and therefore needs relatively little structural space in the fuel injection system.

In some implementations, the outlet valve seat has an outlet valve seat central axis, the pressure-limiting valve seat has a pressure-limiting valve seat central axis, and the valve seat element has a valve seat element longitudinal axis. The outlet valve seat central axis and/or the pressure limiting valve seat central axis are arranged eccentrically with respect to the valve seat element longitudinal axis. In some examples, a spacing of the outlet valve seat central axis and a spacing of the pressure-limiting valve seat central axis from the valve seat element longitudinal axis are equal. It is possible in this way to provide a symmetrical arrangement of the outlet valve seat and of the pressure-limiting valve seat on the valve seat element, which yields advantages in terms of flow.

In some implementations, the valve seat element is formed as a valve housing which, for the outlet valve and/or for the pressure-limiting valve, forms both the respective valve seat and also a guide section, which is formed along a respective valve seat central axis, for guiding the respective valve closing element. In this way, further functions of the respective valves are integrated into the valve seat element. The valve seat element may serve for guiding the outlet valve closing element and the pressure-limiting valve closing element, such that further components for guiding the valve closing elements can be omitted.

The guide section on the valve seat element, which is formed as a valve housing, may be formed by an elongation of the valve seat element in the form of an outflow bore. The elongation gives rise, in the adjacent valve, too, to an elongation of the passage bore on which the valve seat is formed. The elongation then automatically forms an inflow bore. The inflow bore may be of larger diameter than the passage bore that forms the valve seat.

For example, the guide section may be formed only on one side of the valve seat element, whereas the other side of the valve seat element is of flat form. This may be advantageous, for example, if one of the valve closing elements is formed as a flat plate or requires no further guide.

The respective guide section may have at least one outflow bulge which extends radially away from the respective valve seat central axis. In this way, a sufficiently free cross section for the throughflow of fuel is ensured.

In some examples, the guide section has multiple outflow bulges which extend radially away from the valve seat central axis. The multiple outflow bulges may be arranged in flower-shaped form around the valve seat central axis. In some examples, in each case, one guide web for the closing element is formed between the individual outflow bulges. Here, the shape of the guide web is determined by the shape of the closing element. If the valve closing element is, for example, a ball, the guide web may be formed by a partial segment of a cylindrical bore.

In some implementations, the valve housing forms an inflow bore to at least one out of outlet valve and/or pressure-limiting valve, where the outflow bulge associated with a respective valve intersects the inflow bore associated with the respective other valve. In this way, it is also possible in this way to ensure as short a distance as possible between the sealing regions of the two valve seats, because the outflow bulge of one valve intersects the inflow bore of the other valve.

The fuel injection system may have a connecting bore, arranged in a housing of the high-pressure fuel pump, between the pressure chamber and the high-pressure accumulator.

In some implementations, the valve seat element, an outlet valve preload spring, the outlet valve closing element, a pressure-limiting valve preload spring and the pressure-limiting valve closing element are arranged individually in the connecting bore. Here, the valve seat element is fastened directly in the connecting bore, for example by being pressed into the latter.

It may however alternatively also be provided that, to form the valve arrangement, the valve seat element, the outlet valve preload spring, the outlet valve closing element, the pressure-limiting valve preload spring and the pressure-limiting valve closing element are arranged jointly in one cartridge housing, where the cartridge housing is fastened in the connecting bore.

In some examples, the valve arrangement is therefore formed as a separate module which can be set outside the fuel injection system. Here, it is for example possible for both valves to be tested, and for the opening pressure to be adjusted, outside the fuel injection system. Setting by hydraulic measurement is possible without a clean space being contaminated in the process, and lower scrap costs arise in the event of malfunctions of the valves, because the valve arrangement can be easily exchanged independently of other components of the high-pressure fuel pump.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
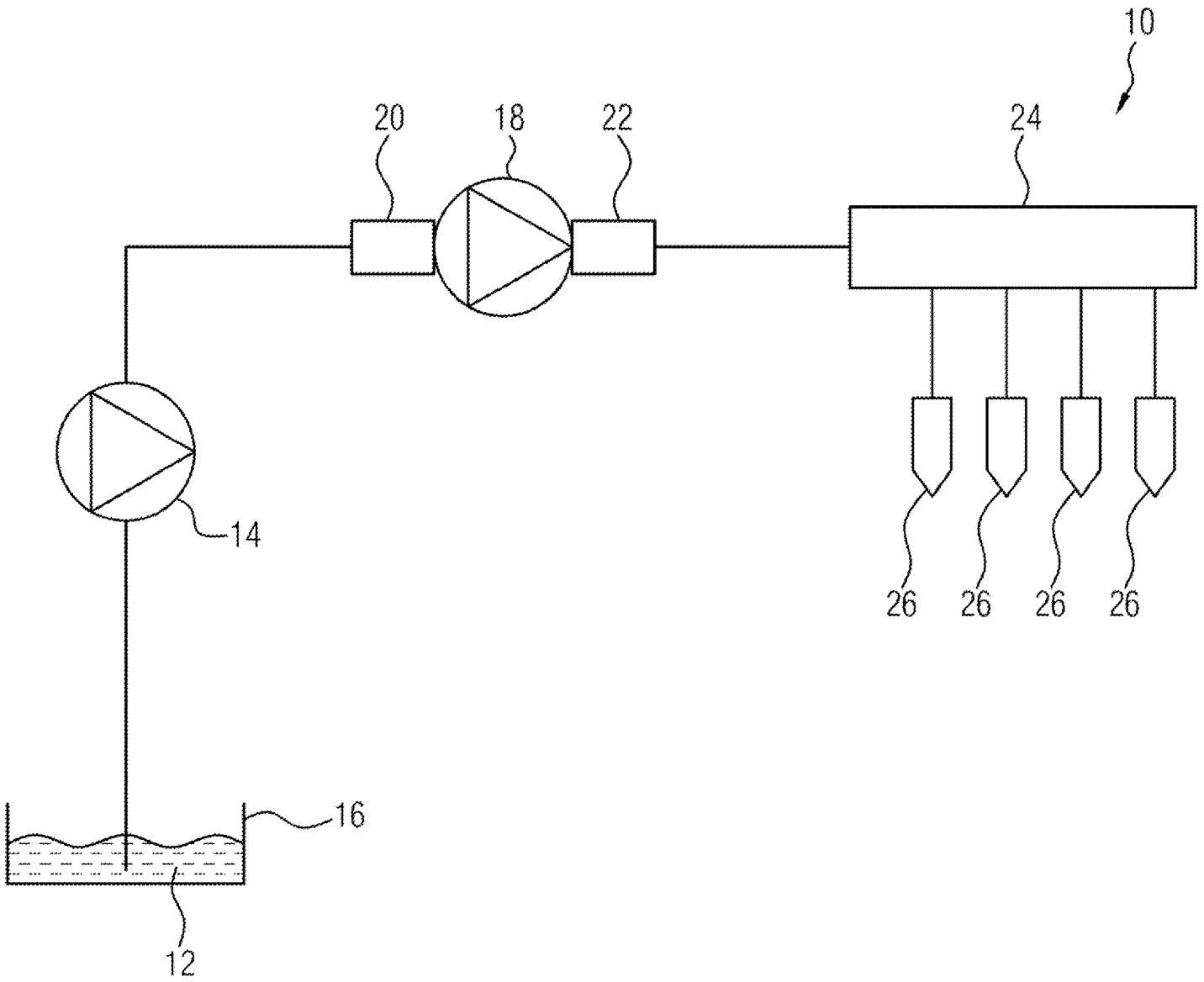
FIG. 1 shows a schematic overview illustration of a fuel injection system having a high-pressure fuel pump and having a high-pressure accumulator.

FIG. 1 shows a schematic overview illustration of a fuel injection system 10, in which a fuel 12 is delivered by a predelivery pump 14 from a tank 16 to a high-pressure fuel pump 18. The fuel 12 is highly pressurized in the high-pressure fuel pump 18, where the quantity of fuel 12 that is pressurized in the high-pressure fuel pump 18 can be set through corresponding active actuation of an inlet valve 20. Via an outlet valve 22, the pressurized fuel 12 is then fed to a high-pressure accumulator 24, on which injectors 26 are arranged via which the pressurized and stored fuel 12 can be injected into combustion chambers of an internal combustion engine.

Figure 2:
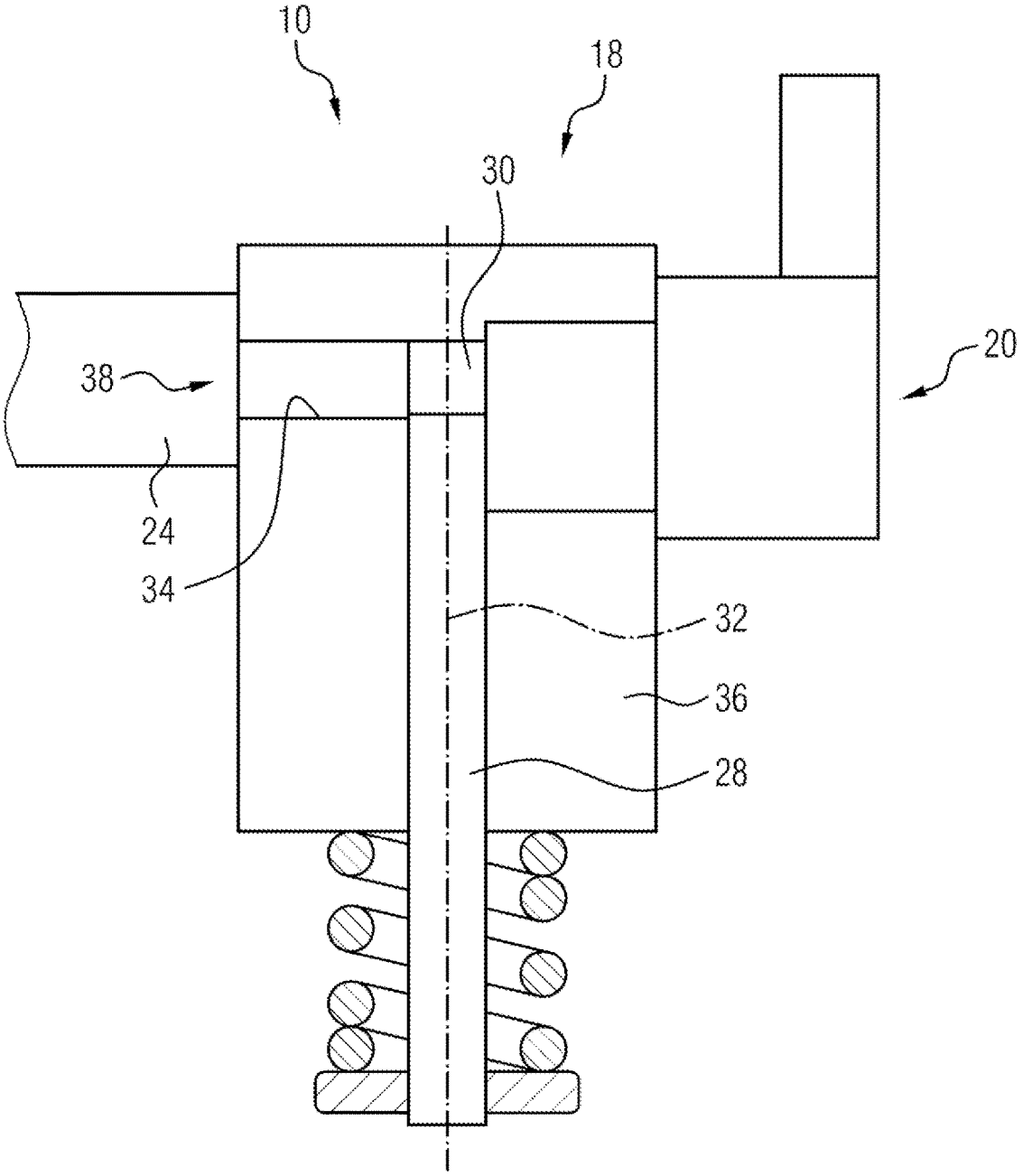
FIG. 2 shows a sectional illustration of a partial region of the fuel injection system from FIG. 1, with a connecting bore arranged between high-pressure accumulator and a pressure chamber of the high-pressure fuel pump.

The high-pressure fuel pump 18 is shown in greater detail in FIG. 2 in a sectional illustration of a partial region of the fuel injection system 10. As Shown, the high-pressure fuel pump 18 is formed as a piston pump and therefore has a pump piston 28, which during operation moves up and down in translational manner along a movement axis 32 in a pressure chamber 30 of the high-pressure fuel pump 18. As a result of the movement, the fuel 12 situated in the pressure chamber 30 is compressed and thus pressurized. Via a connecting bore 34, which is arranged in a housing 36 of the high-pressure fuel pump 18, the pressurized fuel 12 then passes out of the pressure chamber 30 into the high-pressure accumulator 24.

Figure 3:
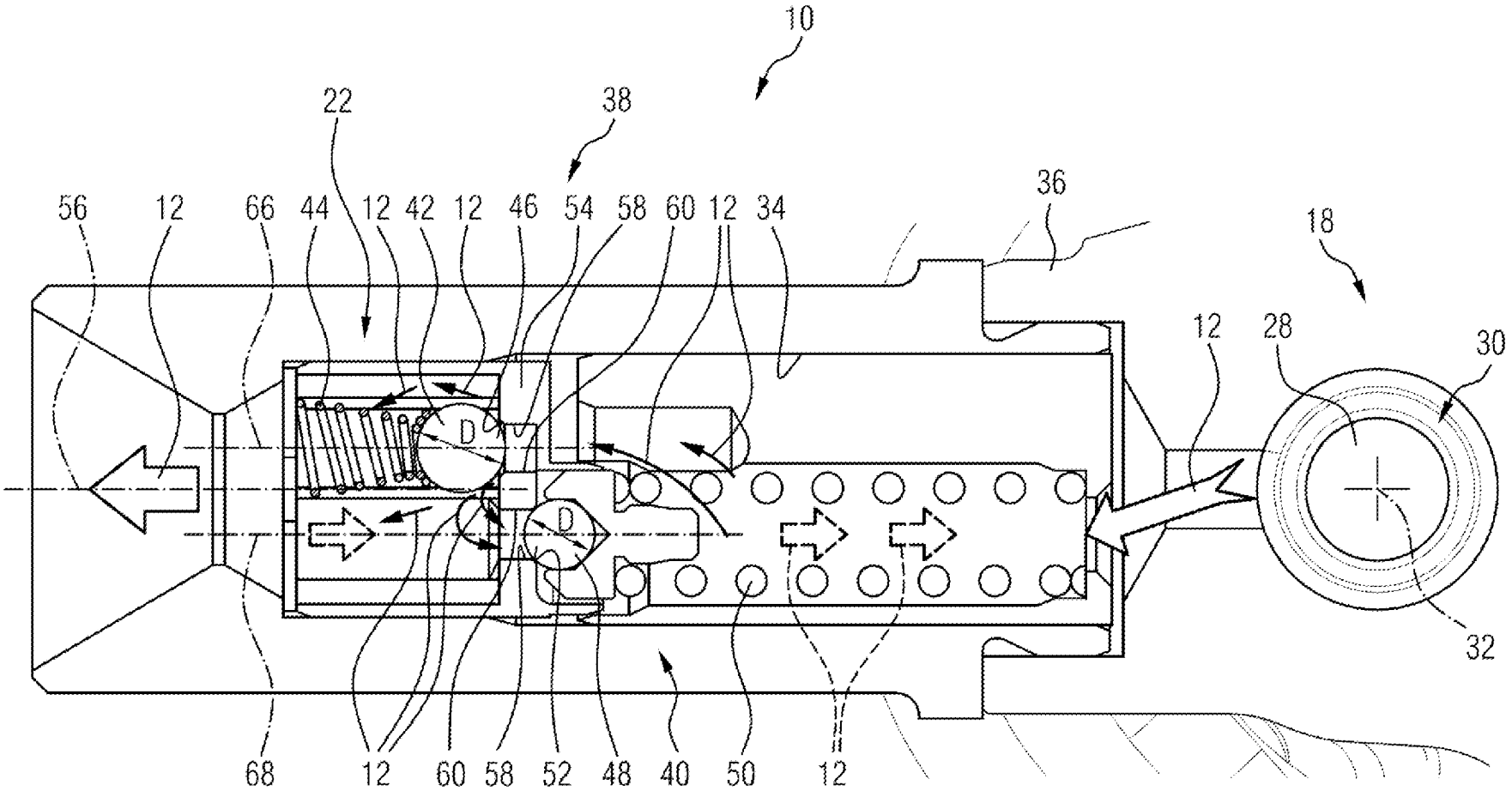
FIG. 3 shows a sectional illustration of the connecting bore from FIG. 2 with a valve arrangement arranged therein, which arrangement has an outlet valve and a pressure-limiting valve.

To be able to provide a desired pressure in the fuel 12 that is situated in the high-pressure accumulator 24, a valve arrangement 38 is arranged in the connecting bore 34, as is shown in a sectional illustration in FIG. 3.

The valve arrangement 38 includes the outlet valve 22, which controls the pressure increase in the pressure chamber 30 of the high-pressure fuel pump 18. The outlet valve 22 ensures that only fuel 12 at the desired pressure exits the pressure chamber 30 in the direction of the high-pressure accumulator 24. Furthermore, said outlet valve prevents a backflow of the compressed fuel 12 back into the pressure chamber 30 when a negative pressure prevails there owing to a downward movement of the pump piston 28.

The valve arrangement 38 furthermore includes a pressure-limiting valve 40. The pressure-limiting valve 40 prevents an excessive pressure increase in the high-pressure accumulator 24, because if the pressure in the high-pressure accumulator 24 exceeds a particular value, a certain volume flow of the fuel 12 is discharged back into the pressure chamber 30 via the pressure-limiting valve 40. The outlet valve 22 and the pressure-limiting valve 40 are both arranged as check valves. Therefore, the outlet valve 22 has an outlet valve closing element 42 which is preloaded against an outlet valve seat 46 by an outlet valve preload spring 44, specifically counter to a pressure force acting from the pressure chamber 30 due to the pressurized fuel 12. If the pressure force exceeds the spring force of the outlet valve preload spring 44, the outlet valve closing element 42 lifts off from the outlet valve seat 46, and pressurized fuel 12 can flow from the pressure chamber 30 in the direction of the high-pressure accumulator 24.

Analogously to this, the pressure-limiting valve 40 has a pressure-limiting valve closing element 48 and a pressure-limiting valve preload spring 50 which preloads the pressure-limiting valve closing element 48 against a pressure-limiting valve seat 52, specifically counter to a pressure force, acting from the high-pressure accumulator 24, of the fuel 12 situated therein. If a high pressure in the fuel 12 that is situated in the high-pressure accumulator 24 exceeds a predetermined value, such that there is the risk of damage in the region of the high-pressure accumulator 24 or in the injectors 26 attached thereto, the pressure-limiting valve closing element 48 is opened by the pressure force of the undesirably high pressure counter to a spring force, which is lower than said undesired pressure force, of the pressure-limiting valve preload spring 50 in order to discharge fuel 12 from the high-pressure accumulator 24 and thus reduce the high pressure prevailing therein.

As shown in FIG. 3, the outlet valve seat 46 and the pressure-limiting valve seat 52 are formed on a single component, specifically a valve seat element 54 formed in one piece. As shown, the two valve seats 46, 52 are arranged not concentrically but rather eccentrically with respect to one another on the valve seat element 54. It is thereby possible for the valve seat element 54 to be kept very short or narrow along a valve seat element longitudinal axis 56, and thus for a very large amount of structural space to be saved along the valve seat element longitudinal axis 56.

Figure 4:
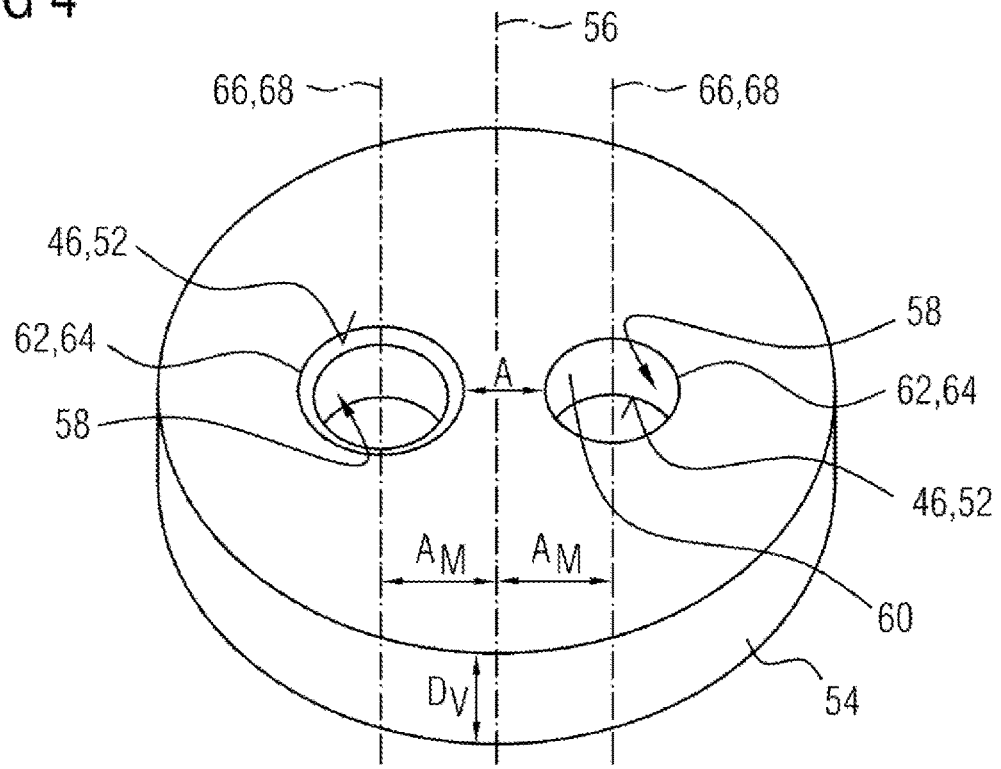
FIG. 4 shows a perspective illustration of a valve seat element of the valve arrangement from FIG. 3 in a first example.

FIG. 4 shows a perspective illustration of a first example of the valve seat element 54. In this first example, the valve seat element 54 serves merely for providing the valve seats 46, 52, and can therefore be kept short or narrow. The other components of the two valves 22, 40, such as for example the closing elements 42, 48 or the preload springs 44, 50, are then installed or guided in the housing 36, specifically in the connecting bore 34 in the housing 36 of the high-pressure fuel pump 18, or in another corresponding component. The valve seat element 54 may, for example, be fastened directly in the connecting bore 34 by simply being pressed in. It can be seen in FIG. 4 that passage bores 58 in the valve seat element 54, which passage bores form the valve seat 46, 52 of one valve 22, 40 and an inflow bore 60 of the respective other valve 22, 40, are arranged relatively close together. For this purpose, the outlet valve seat 46 has an outlet valve seat circumference 62 and the pressure-limiting valve seat 52 has a pressure-limiting valve seat circumference 64, which valve seat circumferences have a spacing A to one another which is smaller than a diameter D of at least one of the closing elements 42, 48. Optimum hydraulic behavior of the high-pressure fuel pump 18 is possible by this short spacing A.

Since both valves 22, 40 are formed on one valve seat element 54, it is merely necessary for a single connecting bore 34 to be provided in order to provide the two valves 22, 40, which are needed, between the pressure chamber 30 and the high-pressure accumulator 24. This results in shorter machining times on the housing 36, because only one bore has to be formed rather than the two bores that have hitherto been provided. Altogether, this leads to a cost saving during the production of the high-pressure fuel pump 18.

A thickness $D_V$ of the valve seat element 54 along the valve seat element longitudinal axis 56 is smaller than the outlet valve seat diameter D and the pressure-limiting valve seat diameter D. In this way, the installation space for the two valves 22, 40 is duly relatively large in terms of diameter as viewed across the valve seat element 54, but is shortened in terms of the thickness $D_V$ or in terms of the length along the depth direction.

To realize symmetrical production of the valve seat element 54 shown in FIG. 4, the passage bores 58 are arranged symmetrically on the valve seat element 54. The outlet valve seat 46 has an outlet valve seat central axis 66 and the pressure-limiting valve seat 52 has a pressure-limiting valve seat central axis 68. For a symmetrical arrangement of the outlet valve seat 46 and of the pressure-limiting valve seat 52 on the valve seat element 54, the central axes 66, 68 have an equal spacing $A_M$ from the valve seat central longitudinal axis 56. It can also be seen in FIG. 4 that the passage bore 58, which on the visible side of the valve seat element 54 forms a valve seat 46, 52 which is conically bevelled to thereby provide the seat for the valve closing element 42, 48. By contrast, the other passage bore 58, which merely forms the inflow bore 60 for the respective other valve 22, 40, is of simple cylindrical form. As already mentioned above, FIG. 4 shows a valve seat element 54 which performs merely the function of forming the valve seats 46, 52.

Figure 5:
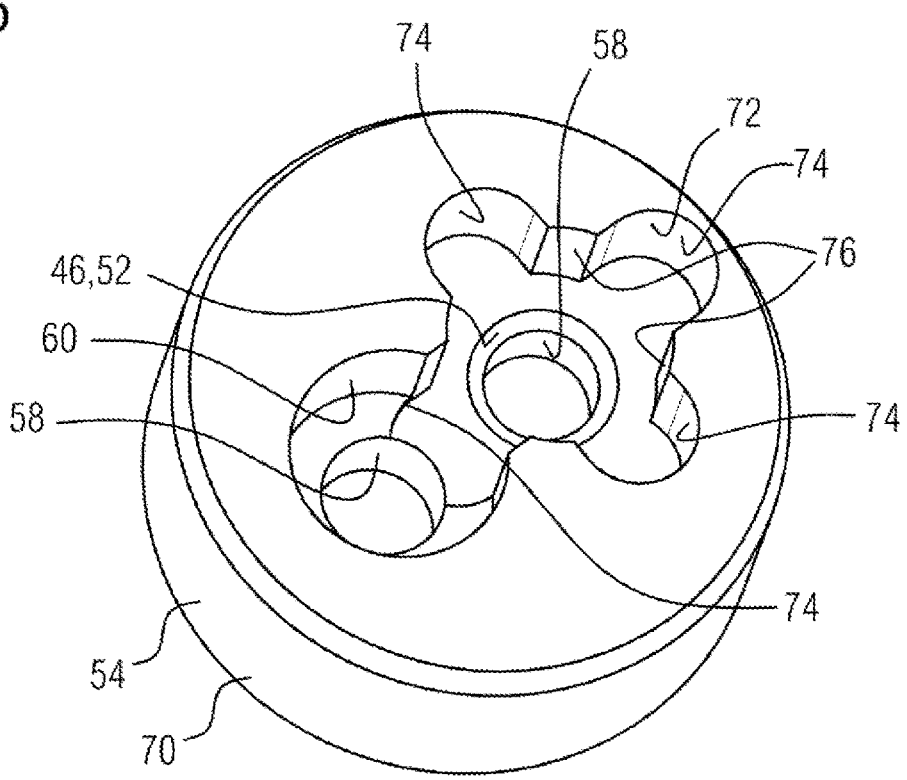
FIG. 5 shows a perspective illustration of the valve seat element of the valve arrangement from FIG. 3 in a second example.

By contrast, FIG. 5 shows a second example which performs further functions aside from forming the valve seats 46, 52. This is because, as is shown in the perspective illustration in FIG. 5, the valve seat element 54 may also be designed so as to simultaneously serve as a valve housing 70 for the outlet valve 22 and/or the pressure-limiting valve 40. In this case, the corresponding closing element 42, 48 is guided in this valve housing 70 because the latter has a guide section 72 for guiding the respective valve closing element 42, 48. Here, the guide section 72 is formed symmetrically around the respective valve seat central axis 66, 68 and extends along the valve seat element longitudinal axis 56.

If the closing element 42, 48 is guided in the valve housing 70 as which the valve seat element 54 as per FIG. 5 is formed, it is necessary for a sufficient free cross section to be provided for the throughflow of the fuel 12. However, it is at the same time also desired for as short a spacing A as possible to be provided between the sealing regions of the two valve seats 46, 52. Therefore, as shown in FIG. 5, at least one outflow bulge 74 is provided on the guide section 72, which outflow bulge extends radially away from the respective valve seat central axis 66, 68. Now, when the respective closing element 42, 48 lifts off from the respective valve seat 46, 52, the fuel 12 can flow radially past the closing element 42, 48 into the outflow bulge 74, and can flow out of the valve housing 70 from there.

As can be seen in FIG. 5, multiple outflow bulges 74 are provided. The bulges 74 are arranged symmetrically around the valve seat central axis 66, 68. Accordingly, the passage bore 58 that is shown is not simply cylindrical but includes multiple segments or cutouts, specifically the outflow bulges 74, which ensure an adequate free cross section for the throughflow of the fuel 12. In the present example, the outflow bulges 74 may be arranged in a flower-shaped manner, with a guide web 76 in between for guiding the closing element 42, 48 that is to be provided here. The guide web 76 are substantially partial segments of a bore, which ensure good guidance, for example, of a closing element 42, 48 designed as a ball. The illustrated example with the four semicircular outflow bulges 74 is reminiscent of a flower design, though it is possible for the number, size and shape of the outflow bulges 74 to be chosen freely, for example in a manner dependent on production costs and/or required cross section.

It can also be seen from FIG. 5 that the adjacent valve 22, 40 has not only the passage bore 58, which on the opposite, non-visible side forms the valve seat 46, 52, but additionally the inflow bore 60, the diameter D of which is larger than the diameter of the passage bore 58 itself. The fuel 12 is then introduced into the passage bore 58 via the inflow bore 60. It can be seen that the inflow bore 60 and at least one outflow bulge 74 intersect. It is thereby possible in this case, too, for as short a distance as possible between the sealing regions of the two valve seats 46, 52 to be ensured.

As described above, the valve seat element 54 or the valve seat element 54 formed as a valve housing 70 may be individually fastened directly in the connecting bore 34, for example by being pressed in, whereas the other elements of the valves 22, 40 are held or supported in the connecting bore 34 in some other way.

It is however alternatively also possible for all of the elements of the valve arrangement 38, specifically the valve seat element 54, the two preload springs 44, 50 and the two closing elements 42, 48, to be provided jointly in one cartridge housing, and thus for the valve arrangement 38 to be prefabricated as a separate module already outside the housing 36. In this case, the two valves 22, 40 may be set and tested or adjusted outside the high-pressure fuel pump 18, and also exchanged if need be, without the entire housing 36 of the high-pressure fuel pump 18 having to be scrapped. The cartridge housing with the entire valve arrangement 38 therein can then, after testing, be fastened directly in the connecting bore 34 of the high-pressure fuel pump 18.

A number of implementations have been described. Nevertheless, it will be understood that various modifications may be made without departing from the spirit and scope of the disclosure. Accordingly, other implementations are within the scope of the following claims.

What is claimed is:

1. A fuel injection system for an internal combustion engine, the fuel injection system comprising:

a high-pressure fuel pump comprising a pressure chamber having a pump piston that moves during operation for highly pressurizing a fuel;

a high-pressure accumulator storing the highly pressurized fuel; and a valve arrangement connecting the pressure chamber to the high-pressure accumulator, the valve arrangement includes:

an outlet valve;

an outlet valve seat, the outlet valve seat being part of the outlet valve;

an outlet valve seat central axis being part of the outlet valve seat;

an outlet valve closing element which is preloaded onto the outlet valve seat counter to a pressure force acting from the pressure chamber, the outlet valve closing element being part of the outlet valve;

a pressure-limiting valve;

a pressure-limiting valve seat, the pressure-limiting valve seat being part of the pressure-limiting valve; and a pressure-limiting valve closing element which is preloaded against the pressure-limiting valve seat counter to a pressure force acting from the high-pressure accumulator, the pressure-limiting valve closing element being part of the pressure-limiting valve;

a valve housing being part of a valve seat element, the outlet valve seat and the pressure-limiting valve seat being formed as part of the valve housing;

a guide section being part of the valve seat element, the guide section formed along the outlet valve seat central axis of the outlet valve seat;

a plurality of outflow bulges being part of the guide section, each of the plurality of outflow bulges extends radially away from the outlet valve seat central axis of the outlet valve seat;

wherein the outlet valve seat and the pressure-limiting valve seat are formed as part of the valve seat element which is formed in one piece;

wherein the outlet valve seat and the pressure-limiting valve seat are arranged eccentrically with respect to one another; and wherein a thickness of the valve seat element along a valve seat element longitudinal axis is smaller than a diameter of the outlet valve closing element and a diameter of the pressure-limiting valve closing element.

2. The fuel injection system of claim 1, wherein the outlet valve seat includes an outlet valve seat circumference and the pressure-limiting valve seat has a pressure-limiting valve seat circumference, wherein a spacing of the outlet valve seat circumference to the pressure-limiting valve seat circumference is smaller than a diameter of the outlet valve closing element and/or a diameter of the pressure-limiting valve closing element.

3. The fuel injection system of claim 1, wherein:

the pressure-limiting valve seat includes a pressure-limiting valve seat central axis;

the outlet valve seat central axis and the pressure-limiting valve seat central axis are arranged eccentrically with respect to the valve seat element longitudinal axis; and a spacing of the outlet valve seat central axis from the valve seat element longitudinal axis and a spacing of the pressure-limiting valve seat central axis from the valve seat element longitudinal axis are equal.

4. The fuel injection system of claim 1, further comprising:

an inflow bore integrally formed as part of the valve housing such that the inflow bore is part of the pressure-limiting valve, and each of the plurality of outflow bulges intersects the inflow bore.

5. The fuel injection system of claim 1, further comprising:

a housing of the high-pressure fuel pump;

a connecting bore, arranged in the housing of the high-pressure fuel pump, between the pressure chamber and the high-pressure accumulator, in which connecting bore the valve seat element, an outlet valve preload spring which is part of the outlet valve, the outlet valve closing element, a pressure-limiting valve preload spring which is part of the pressure-limiting valve, and the pressure-limiting valve closing element are individually arranged, wherein the valve seat element is directly fastened in the connecting bore.

6. The fuel injection system of claim 1, wherein the valve seat element, an outlet valve preload spring which is part of the outlet valve, the outlet valve closing element, a pressure-limiting valve preload spring which is part of the pressure-limiting valve, and the pressure-limiting valve closing element are arranged jointly in one cartridge housing to form the valve arrangement, the cartridge housing is fastened in a connecting bore, arranged in a housing of the high-pressure fuel pump, between the pressure chamber and the high-pressure accumulator.

7. The fuel injection system of claim 1, further comprising an inflow bore integrally formed as part of the valve housing such that the inflow bore is part of the outlet valve, and each of the plurality of outflow bulges intersects the inflow bore.

* * * * *